US006450289B1

(12) United States Patent
Field et al.

(10) Patent No.: US 6,450,289 B1
(45) Date of Patent: Sep. 17, 2002

(54) NOISE ATTENUATION DEVICE

(76) Inventors: Christopher David Field, 70 Terry Street, Rozelle, New South Wales 2039 (AU); Fergus Fricke, 229 Rowntree Street, Balmain, New South Wales 2041 (AU)

( * ) Notice: Subject to any disclaimer, the term of this patent is extended or adjusted under 35 U.S.C. 154(b) by 0 days.

(21) Appl. No.: 09/831,980

(22) PCT Filed: Nov. 16, 1999

(86) PCT No.: PCT/AU99/01012

§ 371 (c)(1),
(2), (4) Date: Sep. 5, 2001

(87) PCT Pub. No.: WO00/29684

PCT Pub. Date: May 25, 2000

(30) Foreign Application Priority Data

Nov. 16, 1998 (AU) ..... PP7129

(51) Int. Cl.[7] ..... E04F 17/04

(52) U.S. Cl. ..... 181/224; 181/196; 181/286; 181/295

(58) Field of Search ..... 181/224, 196, 181/295, 286

(56) References Cited

U.S. PATENT DOCUMENTS

| | | | | |
|---|---|---|---|---|
| 4,091,892 A | * | 5/1978 | Hehmann et al. | 181/286 |
| 5,326,317 A | * | 7/1994 | Ishizu et al. | 454/354 |
| 6,116,375 A | * | 9/2000 | Lorch et al. | 181/224 |

FOREIGN PATENT DOCUMENTS

| | | |
|---|---|---|
| EP | 0 847 040 A2 | 6/1998 |
| WO | WO 97/18549 | 5/1997 |
| WO | WO 99/10608 | 3/1999 |

* cited by examiner

*Primary Examiner*—Shih-Yung Hsieh
(74) *Attorney, Agent, or Firm*—Alan W. Cannon; Bozicevic, Field & Francis LLP

(57) ABSTRACT

A noise attenuation device having an array of quarter wave resonators which have varying mouth widths disposed adjacent an aperture or ventilation opening having a predefined width. The resonators are tuned to a resonant frequency, increasing from one face of the attenuation device to another, and so that the mouth widths are each greater than the width of the aperture or ventilation opening, respectively. Optionally, a second array tuned to a different frequency may be disposed on the opposite side of the aperture and the aperture may be kinked so that there is no direct line of sight through the device.

11 Claims, 11 Drawing Sheets

NOISE ATTENUATION DEVICE

FIELD OF THE INVENTION

This invention relates to a noise attenuation device, and in particular to a compact noise attenuation device.

BACKGROUND OF THE INVENTION

International application No PCT/AU98/00676 the contents of which are incorporated herein by reference. is concerned with the provision of a device that acts to attenuate noise entering a building through a natural ventilation opening. such as a window which allows the occupants of that building to enjoy the benefits of natural ventilation whilst not being subject to undesirable levels of noise.

The international application discloses the use of arrays of quarter wave resonators disposed around a ventilation opening, specifically a partially blocked window. Typically, the resonator arrays are positioned around the ventilation opening. For example, in FIG. 3 of PCT/AU98/00676, they are shown attached to the outside wall of a room to be ventilated around a window in an array in which the resonator which is tuned to the lowest frequency is closest to the wall/opening and the resonators which are tuned to the highest frequency are located furthest from the opening.

The present invention is concerned with improvements in the design and function of the array to provide an improved noise attenuator which may also be used in other applications. For example, the majority of residences in Australia are naturally ventilated rather than sealed and air-conditioned. As a consequence, building facades contain fixed air vents. In older buildings, these fixed air vents are approximately 250 mm by 170 mm each in size, with an typical open area for ventilation of less than 10%. The total area of the fixed vent is one standard brick length by two brick heights. Each room in a typical residence contains at least two vents, located in walls forming the building envelope. The vents are important to maintain human comfort inside the residence by providing adequate ventilation, to ensure satisfactory air flow throughout the residence, to prevent mould growth and to allow gases emitted by furniture to escape. It is desirable to improve the vent such that air flow is maintained or improved but sound transmission reduced.

Another problem, identified by the inventor, is noise produced by air conditioning in offices. Most offices have suspended ceilings. In one popular design, elongate narrow outlets extend along the sides of fluorescent light fittings (large rectangular boxes typically containing two light tubes, sockets and ancillary equipment). Noise from the air conditioning fan and regenerated noise from associated system components is transmitted through air outlet into the office below. In some cases vents are provided adjacent light fittings which are not connected to air conditioning ducts but simply allow a return air path for air to enter the ceiling space. Such vents also act as a noise transmission path and allow voices in particular to travel from one office to another.

It is the aim of the present invention to address the problems discussed above and provide improved noise attenuation devices.

Thus in a first broad aspect of the present invention, there is provided a noise attenuation device for attenuation of noise passing along a vent having a width the array comprising a plurality of rows of tubes having a mouth width w and a length L, the rows being arranged in parallel in side by side relation, and each array including tubes having different mouth widths and lengths so that at least some of the rows of tubes in each array are tuned to a different resonant frequency to others of the rows of tubes in that array;

the open mouths of the tubes being contiguous a gap or ventilation opening having a width H and wherein the tubes satisfy the relation:

$$w>H.$$

To ensure the performance of the device is satisfactory, it is preferred that for the majority of the tubes in the arrays, each ratio of individual tube equivalent diameter (D) to its length (L) (the "scale") satisfies the following relation:

$$D/L<0.25.$$

For a square tube $D=2w/\sqrt{\pi}$, where w is the side width of the square tube.

The device may be optimised for particular applications, for example for natural ventilation in residences as discussed in the introduction.

Thus, according to a second aspect of the present invention there is provided:

a noise attenuation device for insertion in a ventilation aperture in a wall of a building or the like, including a first noise attenuation element comprising an array of quarter wave resonators and a second noise attenuation element comprising an array of quarter wave resonators;

a noise pathway disposed between the first and second noise attenuator elements, each array comprising a plurality of rows of tubes having a mouth width w and a length L, the rows ben arranged in parallel in side by side relation, and each array including tubes having different mouth widths and lengths so that at least some of the rows of tubes in each array are tuned to a different resonant frequency to others of the rows of tubes in that array;

the two arrays being separated by an aperture or ventilation opening having a width H extending from one array to the opposite array;

wherein the aperture is kinked or curved so there is no direct line of vision through the aperture perpendicular to the face of the device.

Fixed air vents in buildings provide an airborne transmission path for noise. By replacing the conventional air vent with the attenuator, noise entering the building through the vent must "interact" with the device.

The present invention also allows an array of vents to be built into a wall where significant air movement is required and thermal comfort is of high priority, in this case several noise attenuators can be used in side by side relation.

The provision of the kink in the attenuator provides an indirect sound path from outside to inside of the building via the fixed air vent ie the air path between the inlet and outlet of the attenuator is not straight. This reduces the sound passing through the device by providing a multiple barrier diffraction effect. Also the angled opening means that the open mouths of the tubes are angled. This provides two significant advantages. First, the angled mouth has a larger cross-sectional area than a conventional tube opening, increasing the useful area used for the desired scattering mechanism. Secondly, in relation to the first effect, the grazing incidence of sound passing the open mouths of the tubes is lessened by the angled opening. The scattering mechanism is most efficient at normal incidence for sound and least efficient for grazing incidence. The angled mouths provide improved performance over grazing incidence. The lack of a direct line of sight through the barrier also has positive implications with regards to building security.

To ensure the performance of the device is satisfactory, it is preferred that for the majority of the tubes in the arrays, each ratio of individual tube equivalent diameter (D) to its length(L) (the "scale") satisfies the following relation:

$$D/L<0.25.$$

For a square tube $D=2w/\sqrt{\pi}$, where w is the side width of the square tube.

This relationship has been based on experiments by the inventor involving the measurements of the frequency response of individual tubes of varying scale. It was found that for tubes not satisfying this relationship, the quality factor (Q) of each of the tubes was not high enough to be most effective as a scatterer.

It is preferred that when the device is installed in a building, the device is arranged such that the tubes having smaller mouth widths are located on the side of the device facing the outside of the building. Tubes with larger mouth widths should be located towards the side closest to the inside of the building. Hence the tubes are to be arranged in order of ascending length (or mouth width) from the side closest to the outside of the building.

It is preferred that tubes of similar mouth widths are located opposing each other on each side of the kinked ventilation aperture.

However, it has been found that tubes with equivalent diameters (D) greater than the width of the ventilation opening (H) where they are located do not require tubes on opposing sides of the ventilation opening. Thus, when the relation D>H applies, then tubes of that diameter only need to be located on one side of the ventilation opening ie, in one of the attenuation elements.

The width of the ventilation aperture will also determine the smallest equivalent tube diameter in the array.

The performance of tubes tuned to high frequencies is most sensitive to the ventilation opening dimensions as shorter wavelengths are involved. The distance from the opposing open ends of individual tubes tuned to higher frequencies where the scattering mechanism is useful is much shorter than for tubes tuned to lower frequencies, which may be demonstrated from the derivation of total energy of an individual tube cavity.

Since the tubes tuned to the highest frequency have the shortest wavelength, the performance of these tubes are determined by the ventilation opening width. It is preferred that the length of the smallest tube, should therefore satisfy the following relation:

$$L>H/2$$

Although tubes not satisfying the above relation would be expected to produce some desired scattering effects, they would not be expected to perform as effectively.

To improve the compactness of the device, the tube with largest mouth width may include an initial straight portion and a second portion which extends at a right angle. The following criteria must be satisfied for the kinked tube to perform effectively:

$$D>H$$

The length of the tube which is perpendicular to the main or initial length must be less than the initial straight length of tube.

In a third aspect of the present invention, there is provided a noise attenuation device for attenuation of noise passing along a vent having a width the array comprising a plurality of rows of tubes having a mouth width w and a length L, the rows being arranged in parallel in side by side relation, and each array including tubes having different mouth widths and lengths so that at least some of the rows of tubes in each array are tuned to a different resonant frequency to others of the rows of tubes in that array;

a plate disposed opposite the array defining an aperture or ventilation gap having a width H therebetween wherein the tubes and ventilation gap satisfy the relation:

$$w>H.$$

The above third aspect of the present invention provides a noise attenuator which is particularly suited to attenuating fan noise in air conditioning ducts and outlets. The tubes are typically arranged in order of increasing frequency from the upper end of the duct closest to the noise source (the air-conditioning fan).

There are also some differences between this second embodiment and the first embodiment. The tubes should be tuned to the fan noise which typically produces lower dominant frequencies to attenuate. This means larger tube widths are required. In fact, in some applications, tubes widths much larger than those illustrated in FIGS. 9 to 11 may be utilised.

BRIEF DESCRIPTION OF THE DRAWINGS

A specific embodiment of the present invention will now be described, by way of example only, and with reference to the accompany drawings in which.

DETAILED DESCRIPTION OF A PREFERRED EMBODIMENT

Figure 1:
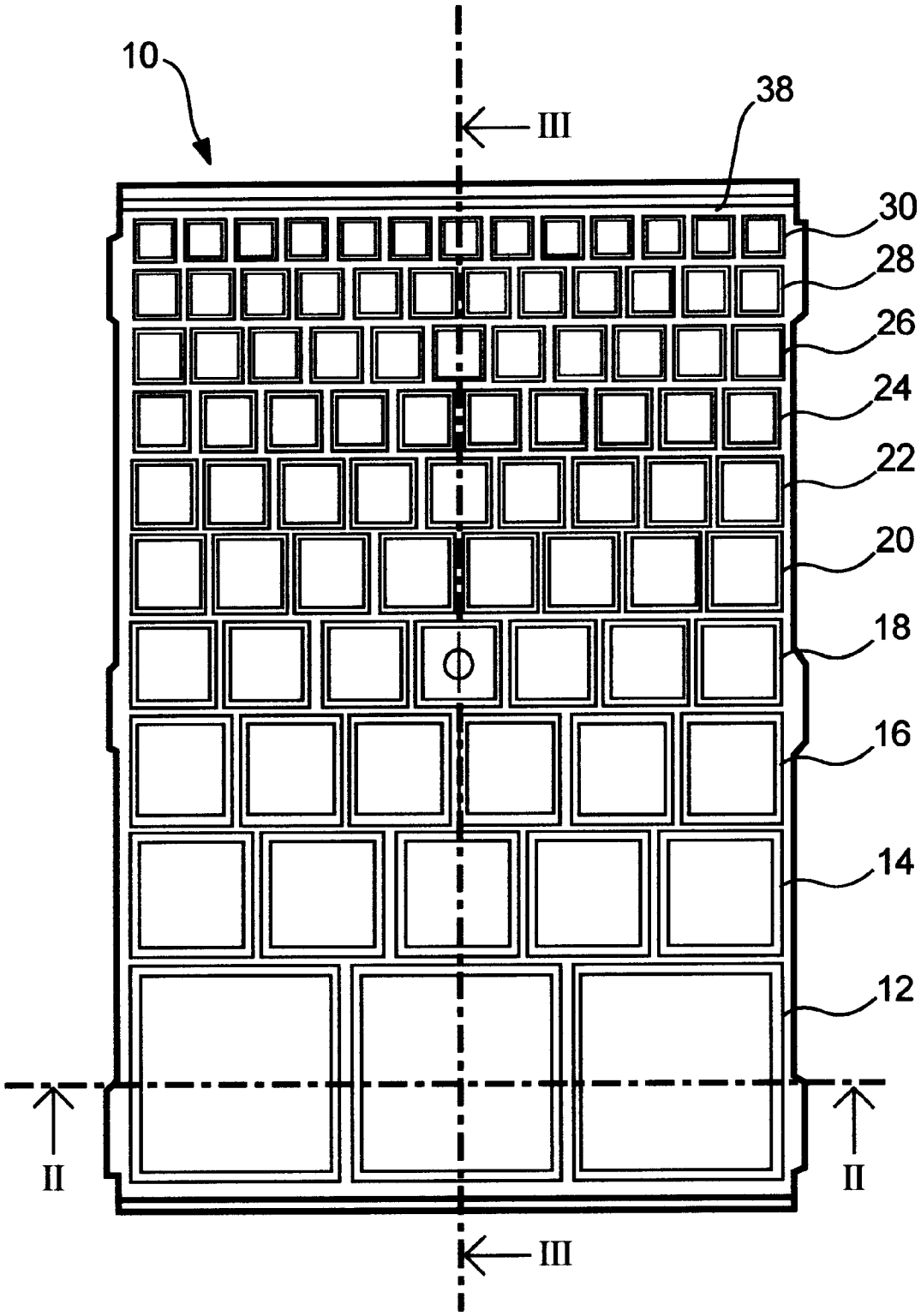
FIG. 1 is a plan view of a first noise attenuator element for use in natural ventilation of a building.
Figure 2:
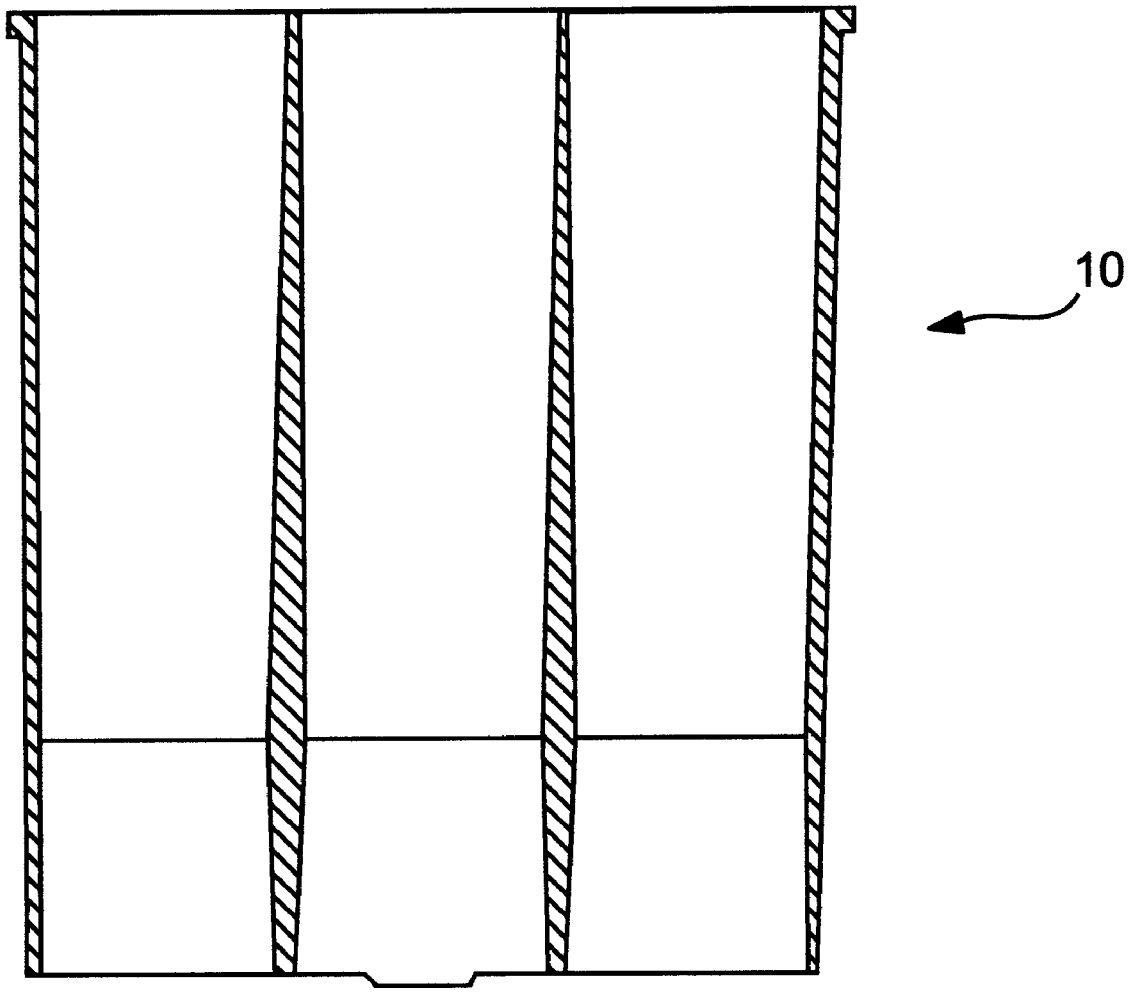
FIG. 2 is a section on lines II—II shown in FIG. 1.
Figure 3:
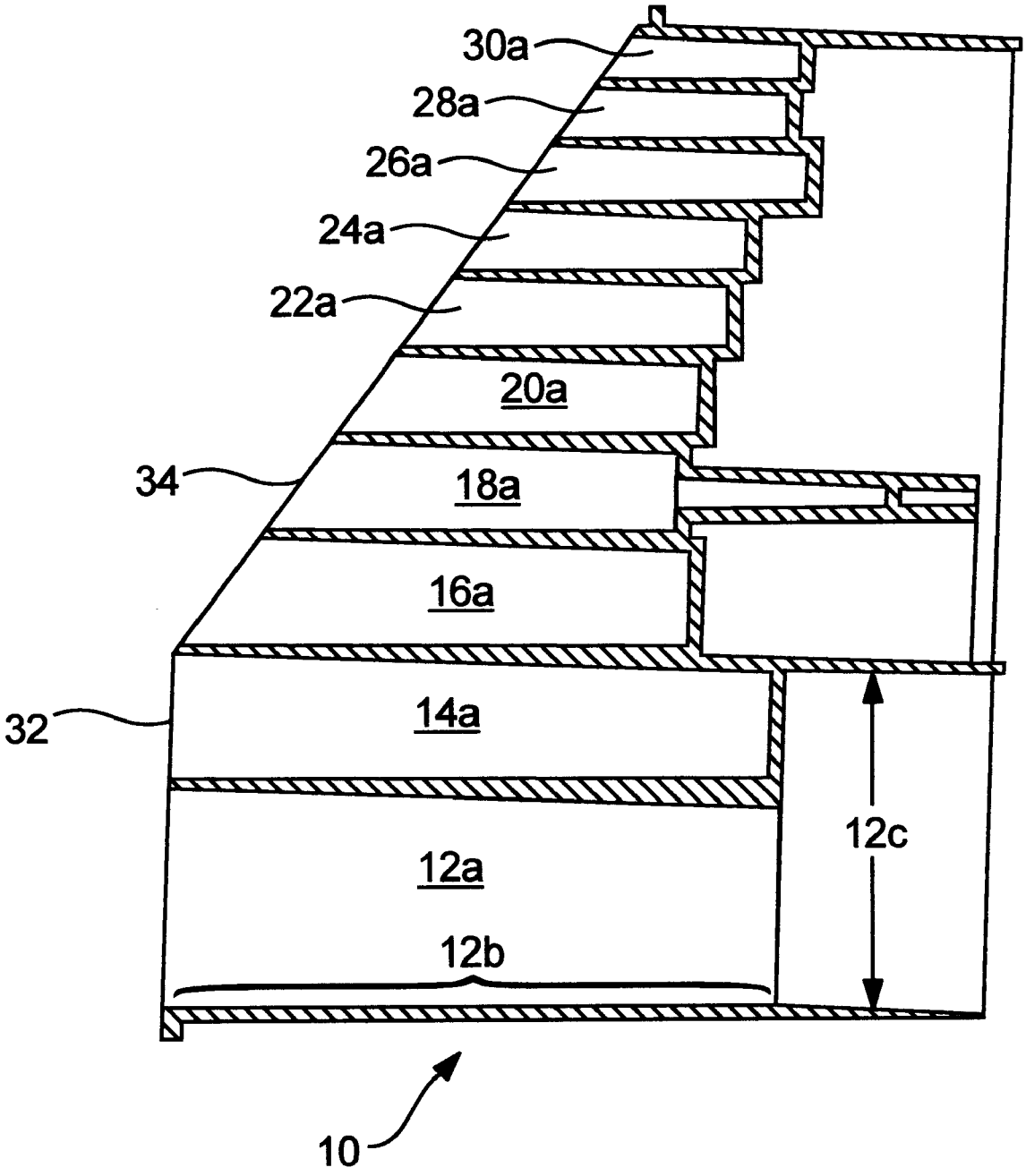
FIG. 3 is a section on lines III—III shown in FIG. 1 which has been modified to show the cross-section of all the tubes of the device.

Referring to the drawings, FIGS. 1 to 3 show first noise attenuator element 10 embodying the present invention. The noise attenuator element comprises an array of parallel rows of resonator cavities or open faced tubes in side by side relation. All the tubes in each row are the same size as each other. The array includes a first row 12 of three square tubes 12*a* of approximately 50 mm square (ie 50 mm×50 mm). Adjacent that row, there is a second row 14 of five square tubes 14*a* each having a cross section of approximately 30 mm×30 mm. Next there is a row 16 of six square tubes 16*a* which are approximately 26 mm square followed by a further seven rows 18, 20, 22, 24, 26 28, 30 of square tubes, each array having an additional tube compared to the adjacent previous tube in the array, finishing with a row 30 of thirteen tubes, 30*a* having a cross section of 9.7 mm×9.7 mm. The height h of the attenuator, measured along the rows is about 150 mm and as each row is made up of square tubes of equal side width the number of tubes in a row determines the width of each tube and vice versa.

With reference to FIG. 2, it can be seen that the tubes are tapered so that the open end of the tubes are wider than their closed ends. The noise attenuator element 10 is moulded in a single piece from a plastics material, although other suitable materials could be used, and the tapering of the tubes enables the device to be more easily released from the mould.

FIG. 3 shows a section through the noise attenuator element along lines III—III from which can be seen that the length of the tubes in each row varies. The tubes having relatively larger mouth widths are generally longer than the tubes having a shorter mouth width.

FIG. 3 also illustrates that the open faces of the tubes in the array defines a first straight face portion 32 defined by the rows of tubes 12 and 14 and a second face portion 34 defined by the open faces of rows 16 through 30. The second face portion is at an angle A of about 240 degrees relative to the first face portion 32. The largest tube 12*a* includes an initial or first tube portion 12*b* which is straight and the a second portion 12*c* which is perpendicular to the first portion. That increases the effective length L of the tube whilst keeping the device compact.

Figure 4:
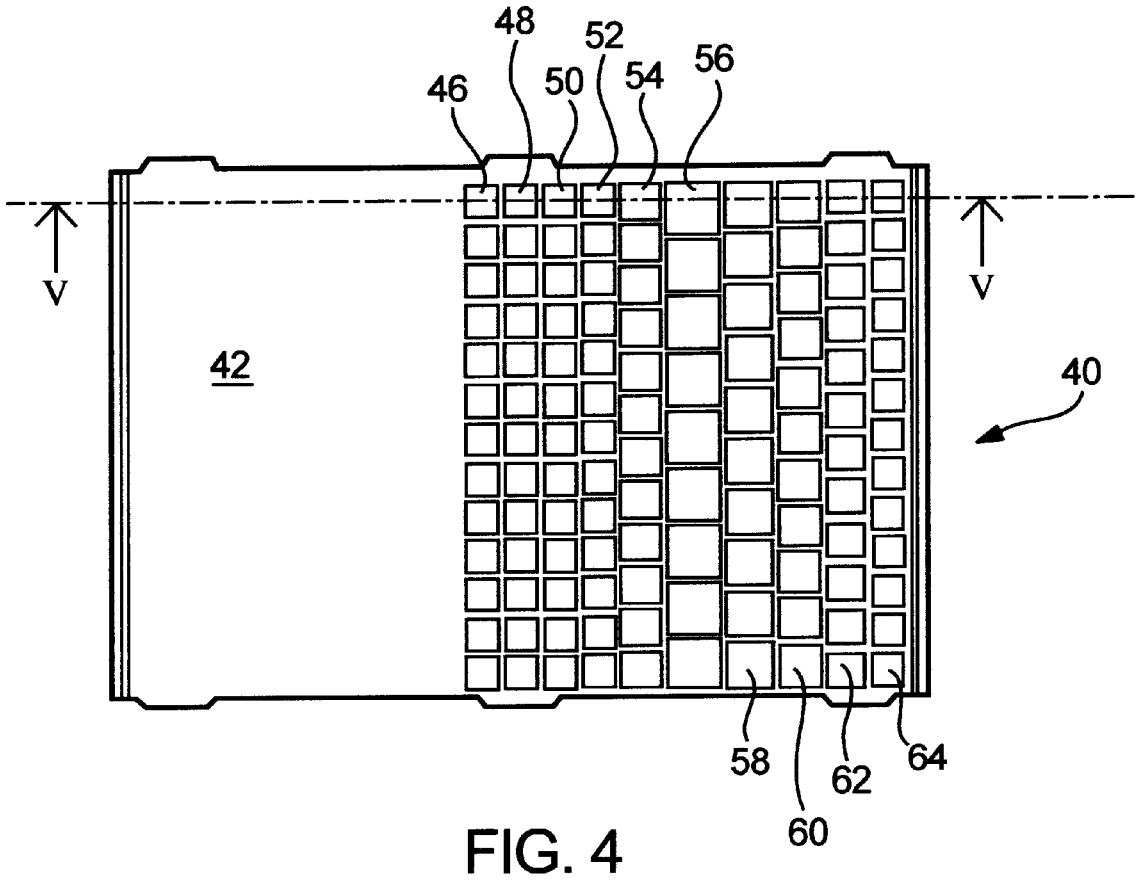
FIG. 4 is a plan view of a second noise attenuator element configured to cooperate with the first noise attenuator element shown in FIGS. 1 to 3.
Figure 5:
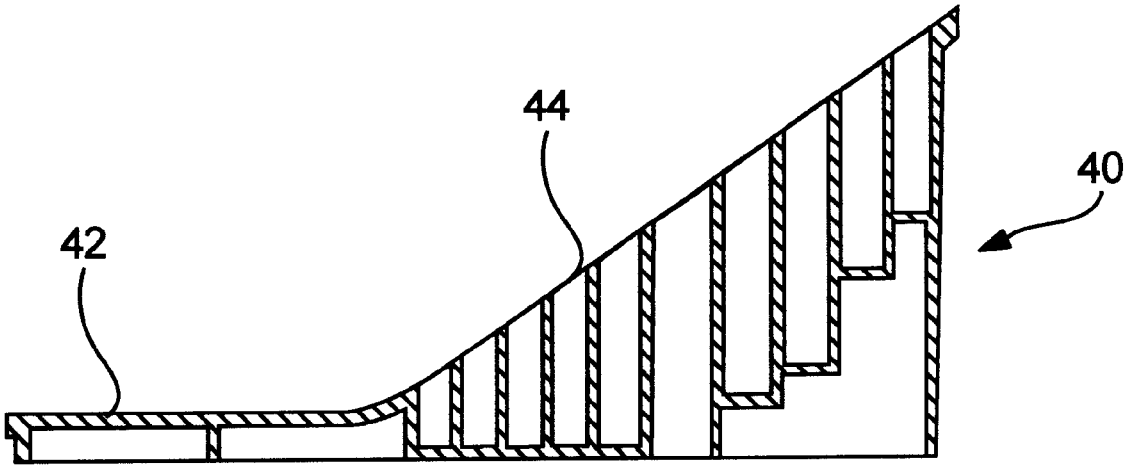
FIG. 5 is a section on lines V—V shown in FIG. 4.

FIGS. 4 and 5 show a second noise attenuator element 40 which is shaped and configured to cooperate with the noise attenuator element shown in FIGS. 1 to 3. This noise attenuator element also defines a series of parallel rows of tubes of square cross section arranged in side-by-side relation. However, unlike the element shown in FIGS. 1 to 3, the tubes do not extend across the entire length of the element. Instead the first part of the element 40 merely defines a flat plate 42. Adjacent the end of the flat plate is an array of ten sets of tubes whose open faces define a plane 44 which is at an angle of about 120 degrees with respect to the flat plate 42. The array of tubes comprises four rows 46, 48, 50, 52 of thirteen tubes having a square cross section of 9.7×9.7 mm and gradually increasing depth. They are followed by a row 54 of twelve square tubes having a cross section of approximately 12 mm×12 mm, a row 56 of nine tubes having a cross section of approximately 16×16 mm followed by a rows 58, 60, 62, 64 of ten, eleven, twelve and thirteen tubes respectively, having gradually decreasing diameters. The lengths of the five tubes gradually decrease as can be seen in FIG. 5.

Figure 6:
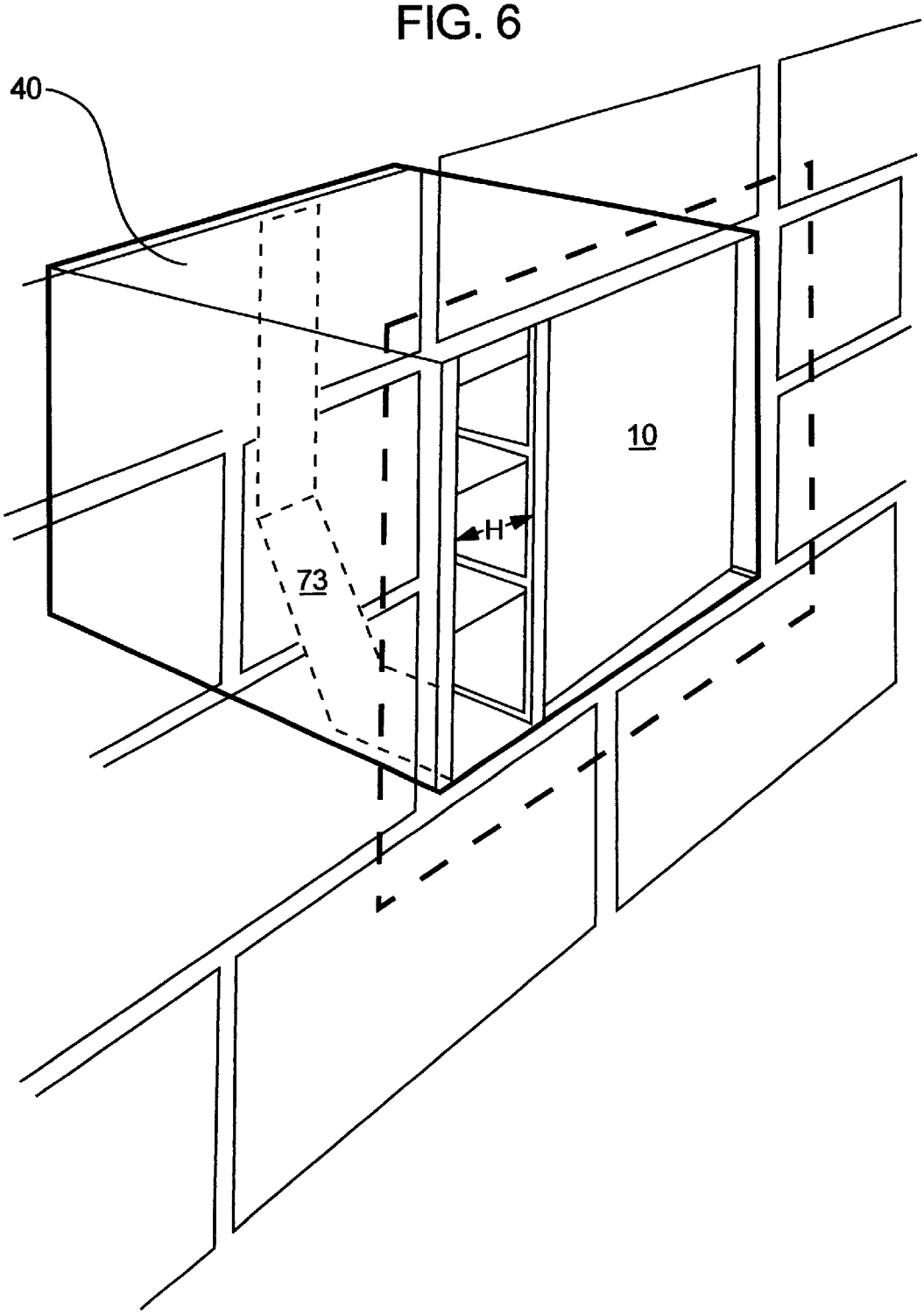
FIG. 6 is a schematic perspective view showing the noise attenuator elements of FIGS. 1 to 5 installed in a cavity in a brick wall.
Figure 7:
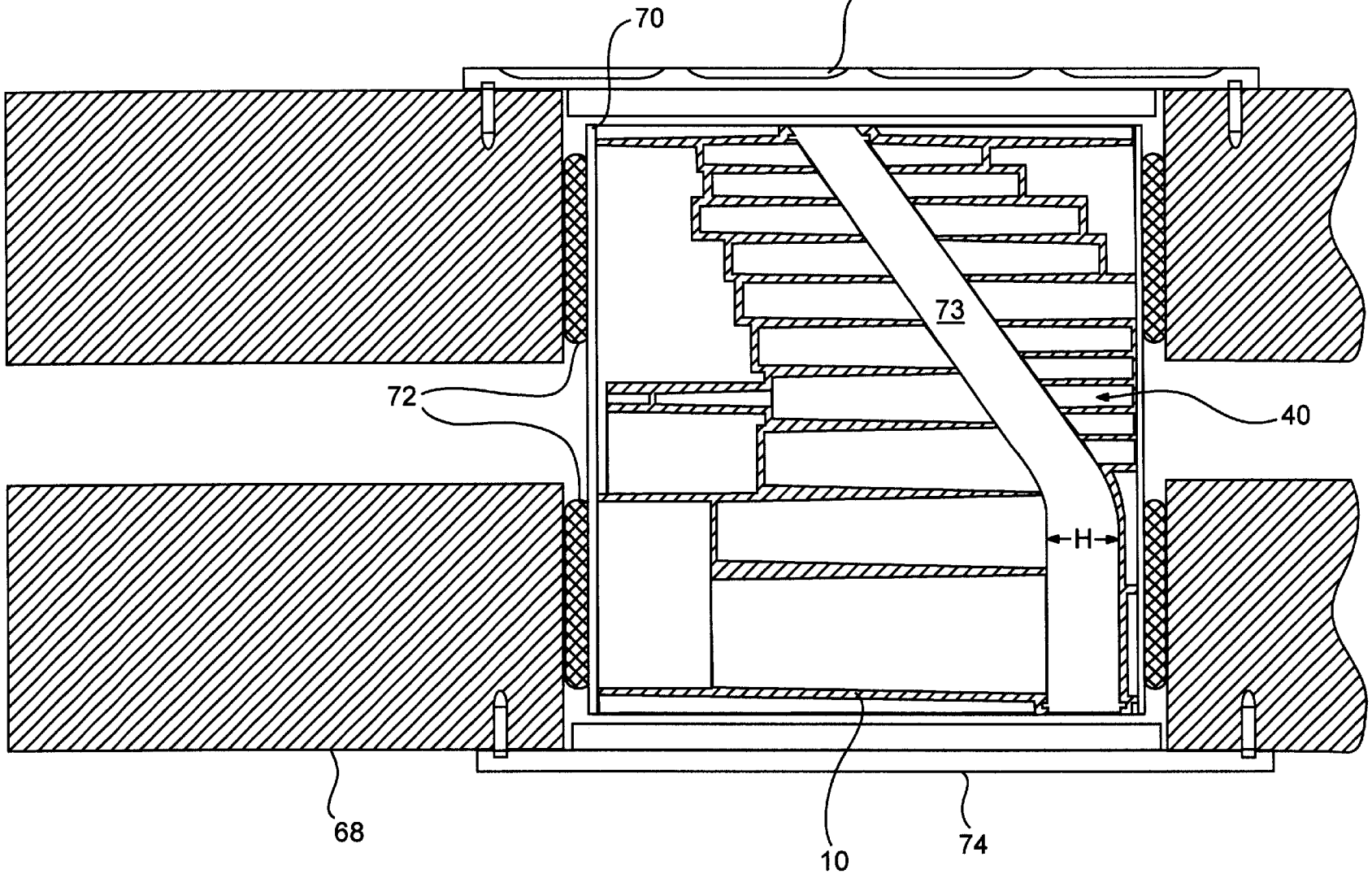
FIG. 7 is a section through the noise attenuator elements affixed in a brick wall with the elements arranged in an opposite configuration to that which is shown in FIG. 6.
Figure 8:
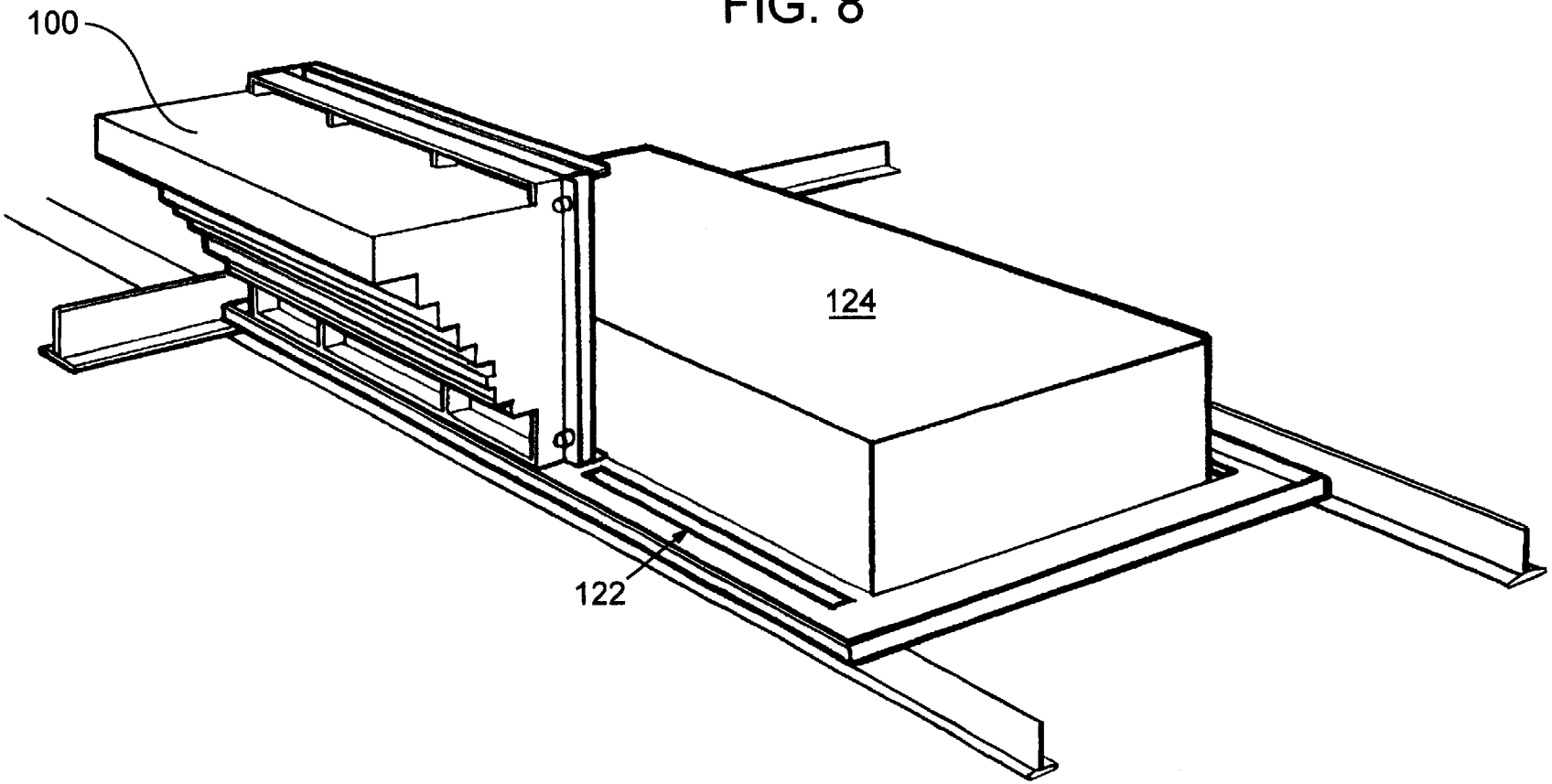
FIG. 8 is a schematic perspective view of a second embodiment of a noise attenuator device for use in reducing noise passing along a vent through an air outlet on or adjacent a fluorescent light fitting in a suspended ceiling grid system.

FIGS. 6 and 7 illustrate the two noise attenuator elements assembled to form a noise attenuator device to fit within a standard fixed air vent of an Australian residence. In most older buildings, the total area of the fixed air vent is one standard brick length by two brick heights which is approximately 250 mm long×170 mm high. The dimensions of the vent and the depth of the wall 68 also determines the depth of the noise attenuator device. Clearly however the dimensions of the noise attenuator of the present invention can be adjusted to suit vents having different dimensions provided that certain rules discussed in detail below are followed for maximum efficiency.

The noise attenuator elements are enclosed in a casing 70 and sealed to the adjacent bricks with a suitable sealant 72. Grills 74 are placed over the cavities to prevent ingress of foreign material into the noise attenuator device but which at the same time allow a relatively free flow of air. As can be seen, when the two noise attenuator elements 10 and 40 are located in the cavity they define an angled or kinked aperture between themselves. The aperture defines an air flow path 73.

The action of the kinked air path in the attenuator provides only an indirect sound path from outside of the building to inside the building via the fixed air vent. This reduces the sound path passing through the device by providing a multiple barrier deflection effect as the sound is dispersed by the tubes which act as quarter wave attenuators. Also the angled opening means that the open mouths of the tubes are angled. This provides two significant advantages. First, the angled mouth has a larger cross-sectional area than a conventional tube opening, increasing the useful area used for the desired scattering mechanism. Secondly, in relation to the first effect, the grazing incidence of sound passing the open mouths of the tubes is lessened by the angled opening. The scattering mechanism is most efficient at normal incidence for sound and least efficient for grazing incidence. The angled mouths provide improved performance over grazing incidence. The lack of a direct line of sight through the barrier also has positive implications with regard to building security.

It is to be noted that the device functions by dispersing or scattering sound waves rather than by absorbing them. By using a number of rows of tubes having different mouth widths and cavity lengths, attenuation can be achieved over a wide range of frequencies.

It has been found that there are a number of important criteria that the components of the noise attenuator device should meet in order to provide optimum noise attenuation. First, the ratio of each individual tube equivalent diameter D to its length (the scale), should satisfy the following relationship.

$$D/L<0.25$$

For a square tube $D=2w/\sqrt{e}$,rad $\pi$, where w is the side width of the square tube.

This relationship is based on experiments by the inventor involving measurements of the frequency response of individual tubes of varying scale. It was found that for a tube is not satisfying this relationship, the quality factor (Q) of each of the tubes was not high enough to be most effective as a scatterer.

It has also been found that the tubes should preferably be arranged such that the smaller cavities with a smaller mouth widths should be located on the side of the device facing the outside of the building in which they are to be installed. The tubes with the largest mouth widths, should be located towards the side closest to the inside of the building. Hence, the tubes should be arranged in order of ascending length (or mouth width) from the side closest to the outside of the building.

It has also been found, that tubes of similar mouth widths, should preferably be located opposing each other on each side of the kinked ventilation opening 73.

The second important relationship to consider, is the width H of the ventilation opening 73 compared to the mouth widths of the tubes. It has been found that tubes with equivalent diameters which are greater than the width H of the ventilation opening where they are located, do not require tubes on opposing sides of the ventilation opening. In other words, if D is greater than H, then the tubes only need to be located on one side of the ventilation opening. Thus, since tubes 12 and 14 have an equivalent diameter which is greater than H, there is no requirement to have opposing tubes.

There is also a requirement relating to the smallest tube width and the width of ventilation opening H which can be determined by considering the frequency of sound to which the tubes are tuned. Performance of tubes tuned to high frequencies is most sensitive to the ventilation opening dimensions, as shorter wave lengths are involved. The distances from or between opposing open ends of individual tubes tuned to higher frequencies where the scattering mechanism is useful, is much shorter than for tubes tuned to lower frequencies. This can be demonstrated from the derivation of total energy of an individual tube cavity. Since the tubes tuned to the highest frequency have the shortest wavelength, the performance of these tubes is determined by the ventilation opening width. Thus, the length of the smallest tube diameter should preferably satisfy the following relationship.

$$L>H/2$$

Note that tubes not satisfying the above relationship are still expected to produce some desired scattering effects. However, they would not be expected to perform effectively.

To improve the compactness of the device, the tube with the largest diameter 12 is right angled. For the kinked tube to perform effectively $$D>H$$

The length of the tube which is perpendicular to the main or initial length must be less than the initial straight length of tube.

Clearly the device described above is a device to attenuate noise in a cavity of a particular size. The dimensions and lengths of the various tubes can be altered to create an attenuation device suitable for attenuating noise through cavities of different lengths, bearing in mind the relations set out above.

FIGS. 8 to 11 illustrate a noise attenuator for use adjacent to light fitting for attenuating noise from air conditioning or air supply to offices.

Figure 12:
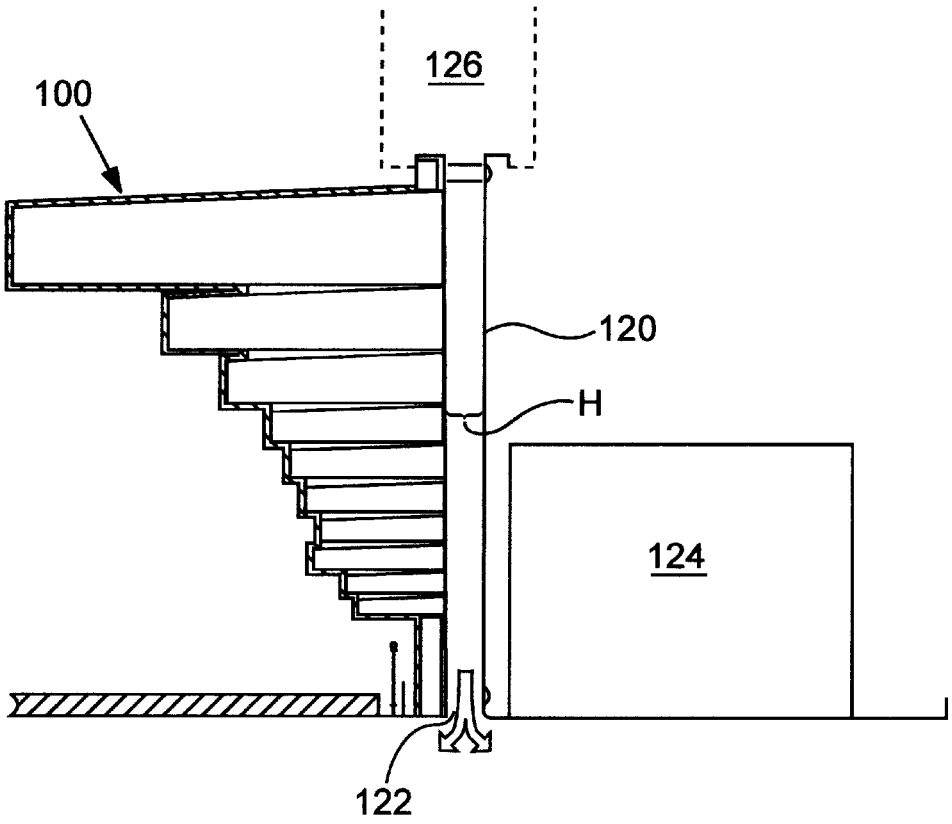
FIG. 12 is a sectional view of an attenuator module as installed adjacent a light fitting.

In most modern offices, the ceiling is based on a suspended grid system above which is located light fittings, air conditioning ducts and other services. In many offices, the air outlet or vents are located adjacent fluorescent light fittings (refer to FIGS. 8 and 12). This results in noise from both the air conditioning system entering offices. In some cases vents are provided adjacent light fittings which are not connected to air conditioning ducts but simply allow a return air path for air to exit the office. Such vents also act as a noise transmission path and allow voices in particular to travel from one office to another.

Figure 9:
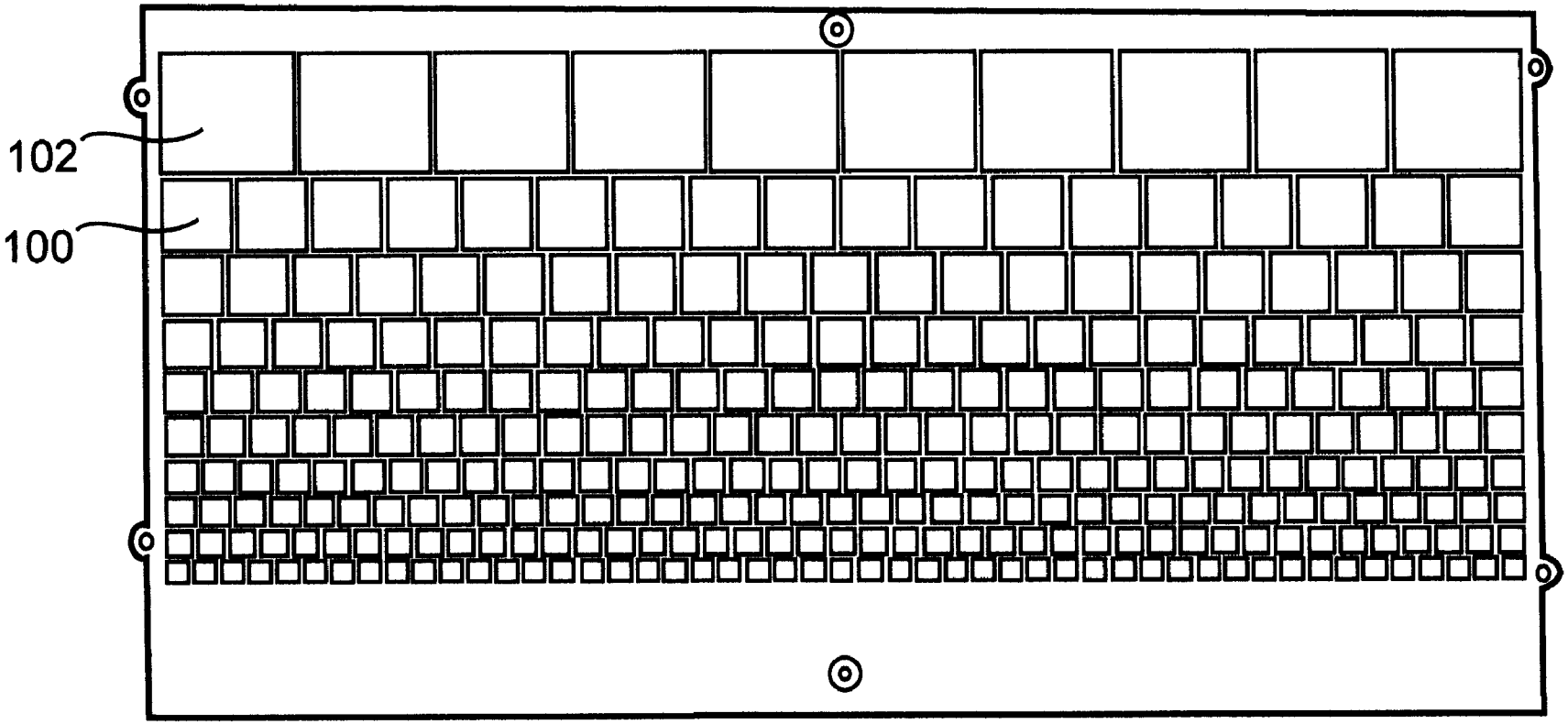
FIG. 9 shows a front view of the tubes of the attenuator shown in FIG. 8, shown with a plate removed.
Figure 10:
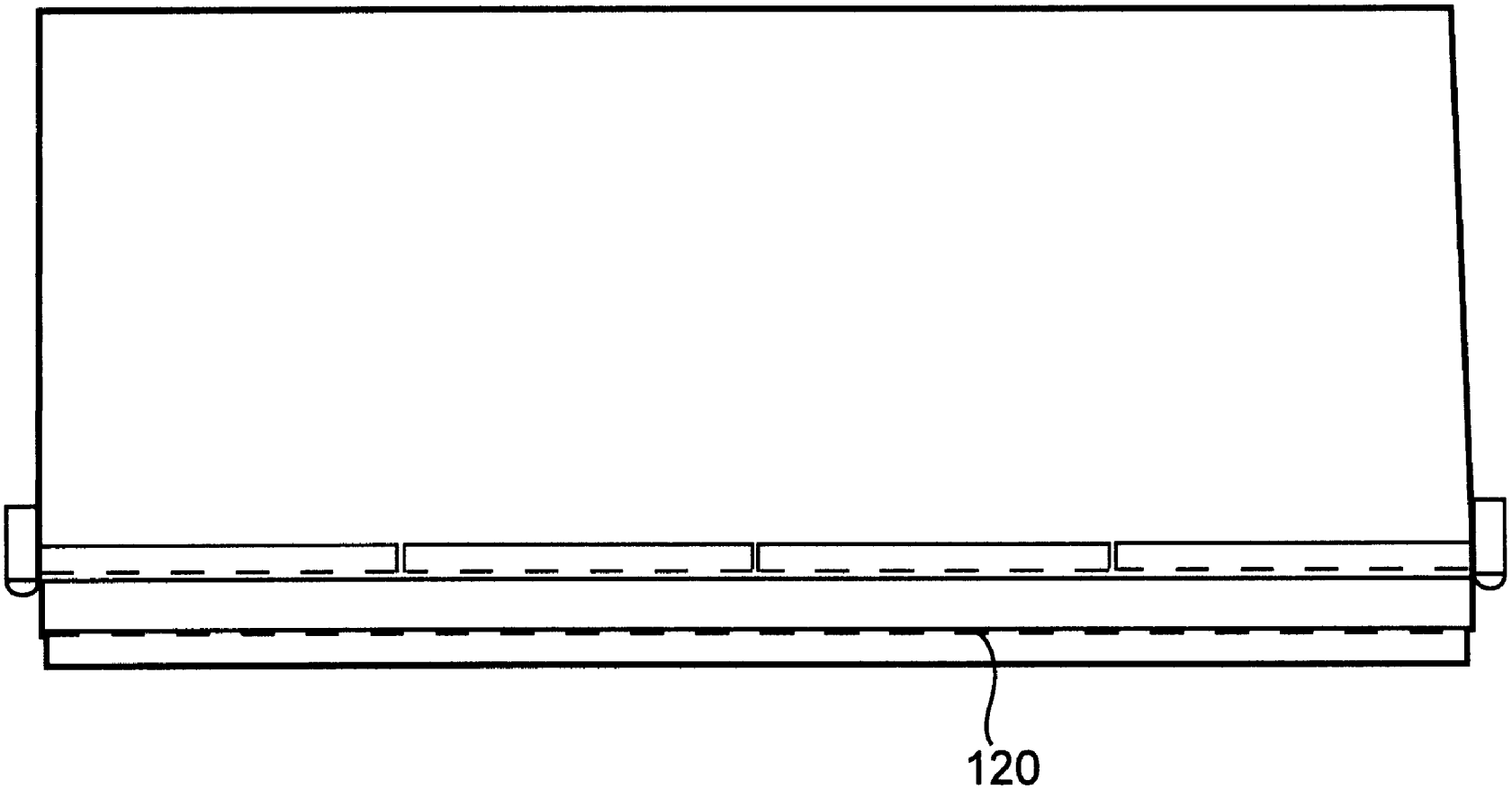
FIG. 10 is a top plan view of the attenuator shown in FIG. 9 illustrating, in particular, an air path.
Figure 11:
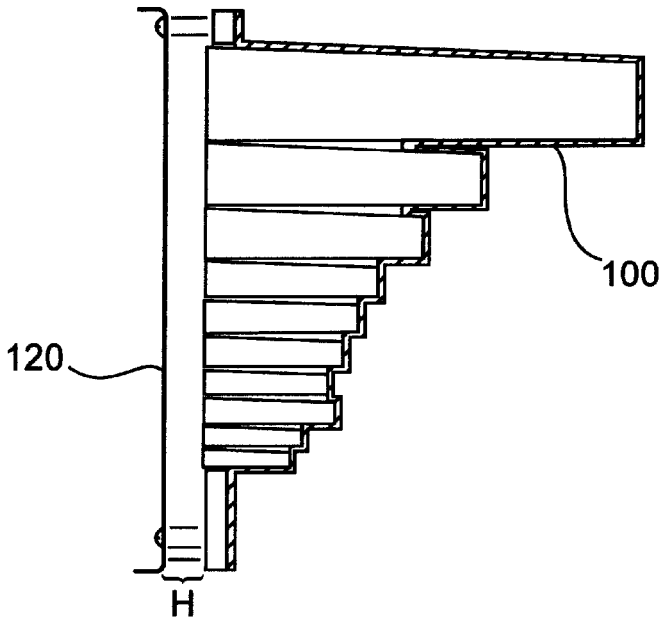
FIG. 11 is a side view showing the attenuator.

FIGS. 9 to 11 illustrate a further noise attenuation device 100 specifically for attenuating noise produced by air outlets into offices and the like.

The attenuator module comprises ten arrays of tubes. The first row 102 of ten tubes has a rectangular cross section and the remaining nine lines having a generally square cross section with the second line of tubes in the array having eighteen tubes and the lowest line of tubes having approximately fifty tubes having a cross-section of approximately 10×10 mm. The noise attenuator is approximately 280 mm high×560 mm long. The depth of the tubes of the attenuator varies as can be seen in FIG. 11 with the tube which is of the greatest width having the greatest depth. A planar metal plate 120 faces the tubes in the attenuator and is spaced 20 mm therefrom defining a duct or air passage therebetween.

The attenuator can be connected to the duct system above a standard vent slot 122 adjacent a light fitting 124 and connected to office air conditioning system.

Many of the criteria which applied to the first embodiment of the noise attenuator device, also applied to the second attenuator module, although due to space constraints and in particular, the light fitting, it is necessary for all of the tubes of the attenuator to be aligned together. Since there is only an array of quarter wave attenuators along one side of the air passage the tubes must all satisfy the relation w>H. The tubes are also arranged in order of increasing frequency from the upper end of the duct closest to the noise source (the air-conditioning fan).

There are also some differences between this second embodiment and the first embodiment. The tubes should be tuned to the fan noise which typically produces lower dominant frequencies to attenuate. This means larger tube widths are required. In fact, in some applications, tubes widths much larger than those illustrated in FIGS. 9 to 11 may be utilised.

A straight opening can be provided because there is no security issue with ceiling vents. Also the barrier effect caused by angling the opening is not significant for the low frequencies which are typically produced by fans.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A noise attenuation device including an array of quarter wave attenuators, the array comprising a plurality of rows of tubes having a mouth width w and a length L, the rows being arranged in parallel in side by side relation, each array including tubes having different mouth widths and lengths so that at least some of the rows of tubes in each array are tuned to a different resonant frequency to others of the rows of tubes in that array;

the mouths of the tubes being contiguous a gap or ventilation opening having a width H; and wherein the width of the tubes satisfy the relation:

$$w>H.$$

2. A noise attenuation device as claimed in claim 1 wherein 85% or more of the tubes in the arrays satisfy the relation;

$$D/L<0.25;$$

where for each tube D is the individual tube equivalent diameter (D) and L is the length (L) of that tube.

3. A noise attenuation device as claimed in claim 1 wherein the length of the smallest tube in the array satisfies the following relation:

$$L>H/2;$$

where H is the width of the ventilation opening.

4. A noise attenuation device as claimed in claim 1, for insertion in a ventilation aperture in a wall of a building, said device including two arrays of quarter wave attenuators being a first noise attenuation element comprising a first array of quarter wave resonators and a second noise attenuation element comprising a second array of quarter wave resonators;

a noise pathway disposed between the first and second noise attenuator elements;

the two arrays being separated by a ventilation aperture having a width H extending from one array to the opposite array;

wherein the aperture is kinked or curved such that there is no direct line of vision through the aperture.

5. A noise attenuation device as claimed in claim 4 wherein at least 85% of the tubes in the first and second arrays satisfy the following relation:

$$D/L<0.25$$

wherein D is the equivalent diameter of the tube; and

L is the length of that tube.

6. A noise attenuation device as claimed in claim 5 wherein tubes having substantially identical mouth widths are located opposing each other on each side of the ventilation aperture.

7. A noise attenuation device as claimed in claim 6 wherein any tubes having equivalent diameters (D) greater than the width of the ventilation opening (H) are located on one side only of the ventilation opening.

8. A noise attenuation device as claimed in claim 7 wherein the length (L) of the smallest tube in the array satisfies the following relation:

$$L>H/2;$$

where H is the width of the ventilation opening.

9. A noise attenuation device for attenuation of noise passing along or through a vent in a ceiling having a width, the noise attenuation device including an array of quarter wave attenuators, the array comprising a plurality of rows of tubes having a mouth width w and a length L, the rows being arranged in parallel in side by side relation, and each array including tubes having different mouth widths and lengths so that at least some of the rows of tubes in each array are tuned to a different resonant frequency to others of the rows of tubes in that array;

a plate disposed opposite the array defining an aperture or ventilation gap having a width H therebetween wherein the tubes and ventilation gap satisfy the relation:

$$w>H.$$

10. A noise attenuation device as claimed in claim 9 wherein the substantial majority of the tubes in the arrays satisfy the following relation:

$$D/L<0.25$$

Wherein D is the equivalent diameter of the tube; and

L is the length of that tube.

11. A noise attenuation device as claimed in claim 10 wherein the length of the smallest tube in the array satisfies the following relation:

$$L>H/2;$$

where H is the width of the ventilation opening.

* * * * *

UNITED STATES PATENT AND TRADEMARK OFFICE

CERTIFICATE OF CORRECTION

PATENT NO. : 6,450,289 B1 
DATED : September 17, 2002
INVENTOR(S) : Field, Christopher David et al.

It is certified that error appears in the above-identified patent and that said Letters Patent is hereby corrected as shown below:

Column 6,
Line 48, change "D=2w/√e,rad π," with --D=2w/ $\sqrt{\pi}$ , --.

Signed and Sealed this

Eighth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,450,289 B1 
DATED : September 17, 2002
INVENTOR(S) : Field, Christopher David et al.

It is certified that error appears in the above-identified patent and that said Letters Patent is hereby corrected as shown below:

Column 1,
Line 13, please delete “opening. such as a window” and insert therefor -- opening, such as a window, --.

Column 2,
Line 33, please delete “ben” and insert therefor -- being --.

Signed and Sealed this

Twenty-eighth Day of September, 2004

JON W. DUDAS
*Director of the United States Patent and Trademark Office*